US005638669A

United States Patent [19]

Kallmann

[11] Patent Number: 5,638,669

[45] Date of Patent: Jun. 17, 1997

[54] METHOD AND DEVICE FOR MANUFACTURING A TWISTED YARN BY AN INTEGRATED RING SPINNING AND TWISTING PROCESS

[75] Inventor: Jürgen Kallmann, Kaarst, Germany

[73] Assignee: Palitex Project-Company GmbH, Krefeld, Germany

[21] Appl. No.: 514,404

[22] Filed: Aug. 11, 1995

[30] Foreign Application Priority Data

Aug. 13, 1994 [DE] Germany ..... 44 28 780.1

[51] Int. Cl.$^6$ ..... D02G 3/36; D01H 7/64

[52] U.S. Cl. ..... 57/6; 57/1 R; 57/3; 57/58.3; 57/75; 57/119; 57/122

[58] Field of Search ..... 57/66, 3, 6, 12, 57/1 R, 58.3, 75, 122, 119

[56] References Cited

U.S. PATENT DOCUMENTS

| | | | |
|---|---|---|---|
| 1,153,190 | 9/1915 | Booth | 57/75 |
| 3,119,225 | 1/1964 | Davis et al. | 57/75 |
| 3,425,209 | 2/1969 | Goy | 57/157 |
| 3,903,681 | 9/1975 | Bous | 57/75 |
| 5,168,697 | 12/1992 | Brockmanns et al. | 57/75 |

FOREIGN PATENT DOCUMENTS

| | | | |
|---|---|---|---|
| 3124942 | 1/1983 | Germany | 57/3 |
| 3148874 | 6/1983 | Germany . | |
| 4235433 | 5/1994 | Germany . | |
| 3152436 | 6/1988 | Japan | 57/5 |

OTHER PUBLICATIONS

Eine neue Spinn–Zwirnmaschine; Melliand–Textilberichte; Dec./1966; pp. 1354 and 1355.

Eine neue Spinn–Zwirnmaschine; Melliand–Textilberichte; Dec/1966; pp. 1354 and 1355.

*Primary Examiner*—William Stryjewski

*Attorney, Agent, or Firm*—Robert W. Becker & Associates

[57] ABSTRACT

A method for manufacturing a twisted yarn includes the step of removing two rovings from two separate supplies and passing each roving through a separate drawing device. From each roving a separate spun yarn is produced by ring-spinning. Each spun yarn is collected in the form of a bobbin on a yarn carrier of separate hollow spindles, wherein the separate hollow spindles are positioned atop one another. With formation of a yarn balloon the spun yarn is withdrawn from the bobbins and guided through the hollow spindle axle of the respective hollow spindle. The spun yarn withdrawn from the upper one of the hollow spindles is guided through the hollow spindle axle of the lower one of the hollow spindles. Both spun yarns are then guided together to a winding device positioned below the lower one of the hollow spindles. The hollow spindles are rotated as a function of the winding speed of the winding device such that a twist of the spun fibers is at least partially canceled.

5 Claims, 2 Drawing Sheets

METHOD AND DEVICE FOR MANUFACTURING A TWISTED YARN BY AN INTEGRATED RING SPINNING AND TWISTING PROCESS

BACKGROUND OF THE INVENTION

Twisted yarns are in general produced in a multi-step method whereby the known methods and devices substantially comprise the following individual steps, respectively, individual features:

1. From a roving supply rovings are guided via a drawing device to a ring spinning spindle on which the spun yarns are wound onto spool sleeves. The resulting bobbins, mostly in the form of cops, are rewound in a second method step on a winding machine to form cross-wound spools. In a third method step two or more cross-wound spools are rewound on a doubling winder. The doubled cross-wound spools are then used as a supply in a fourth method step, for example, in a two-for-one twisting machine in order to manufacture the finished twisted yarn.

By eliminating the third method step it is also possible to supply the two-for-one twisting machine directly with two cross-wound spools produced by the winding machine for manufacturing the finished twisted yarn.

2. Spun yarns are produced according to the open end spinning process and are wound onto sleeves to form cross-wound spools. As needed, two or more of these cross-wound spools are subsequently wound on a doubling winder to a doubled cross-wound spool. The cross-wounds spools are then used in pairs or, in the case of a doubled cross-wound spool, as a single spool for twisting on a two-for-one twisting spindle.
3. In order to unify the three processes spinning, winding, and twisting into a single continuous process a yarn cop that has been produced, for example, on a conventional ring spinning spindle is placed on a hollow spindle. A roving being supplied from a separate roving supply, for example, in the form of a beam creel, passes through a conventional drawing device and is then introduced together with the spun yarn of the yarn cops positioned on the hollow spindle into the hollow spindle axle. The yarn of the yarn spool is withdrawn due to the spindle rotation and runs together with the pre-drawn roving through the hollow spindle to a winding device, respectively, a winding location. This is, for example, disclosed in "Eine neue Spinnzwirnmaschine" "Melliand-Textilberichte 12/1966", pages 1354 and 1355.
4. According to German Offenlegungschrift 31 48 874 machines with drawing devices and rewinding spindles are known whereby the yarns, supplied via the drawing device, are guided through the axles of the hollow spindle, optionally with twisting, to a winding device via supply cylinders. The hollow spindles must be supplied with cops or parallel wound spools of special embodiments. The yarns of these cops or spools cannot be compared to the spool bodies according to paragraphs 1 and 2 supra. They have only the type of winding of a cop winding or a parallel wound disk spool and are not produced on spinning machines but instead on respective winding machines. The yarn supply of the spool body is in most cases a filament yarn. By rotating the hollow spindle in a predetermined rotational direction and by preadjusted the rpm ratios (rpm=revolutions per minute) of drawing device, supply cylinder, and winding action a wrapped yarn is produced.

Even though the process described in paragraph 3 supra claims to combine the three processes spinning, twisting, and winding into a single continuous process, it is obvious that this method for the reasons disclosed above cannot completely fulfill this claim because it is always necessary in a first method step, for example, with a conventional ring spinning machine, to produce a spun yarn which is wound on the ring spinning machine to a cop that is then, according to the method described in paragraph 3 supra, twisted together with the predrawn roving. The yarn body produced on a ring spinning machine thus has to be transported between machines of almost identical function and processing steps whereby especially the removal and reinsertion of yarn spools, on the one hand, and of empty spools, on the other hand, requires a considerable manipulation expenditure which especially with automated method steps results in a high investments for the automation of the machine.

5. In German Offenlegungschrift 42 35 433 a method for manufacturing a twisted yarn is disclosed in which in a first method step a roving, removed from a roving supply and guided through a drawing device, is spun by a ring spinning process and is wound onto a yarn carrier permanently attached to a hollow spindle in order to produce a spun yarn body. In a second step the spinning process is interrupted and the spun yarn, which has been previously wound to form the spun yarn body, is removed from the spun yarn body under balloon formation. Together with a roving, removed from a roving supply and stretched in a drawing device, the spun yarn is guided through the hollow axle of a hollow spindle to a winding device whereby the hollow spindle as a function of the feed velocity of the friction rollers of the winding device is being rotated such that the twist of the spun yarn is canceled.

A substantially identical method is also disclosed in U.S. Pat. No. 3,425,209. In this method the twisting step is carried out with a base yarn that is already twisted and a second base yarn which is in the form of a fiber roving.

A uniform twisted yarn with respect to both base yarns is produced with this method when the base yarn that is pretwisted has its twist canceled by twisting it counter to the spinning direction and when it is then twisted together with the roving coming from the drawing device in the hollow spindle axle. The yarn portion resulting from the roving is not provided with a twist in this method step. When both yarn portions are to have a same twist, as is expected from a balanced twisted yarn, then this can only be achieved when the twist of the spun yarn of the spun base yarn body resulting from the spinning process is canceled during the second method phase, i.e., during the twisting phase, so as to be completely canceled. With this method it is thus impossible to produce twisted yarns having an incompletely compensated twist.

It is therefore an object of the invention to provide a combined spinning and twisting method and a corresponding device with which it is possible to achieve in the finished twisted yarn any desired twist relation between the individual yarns, respectively, individual base threads, on the one hand, and the twisted yarn twist, on the other hand.

Twisted yarns of this character, i.e., with incompletely compensated twist, are most frequently employed.

SUMMARY OF THE INVENTION

A method for manufacturing a twisted yarn according to the present invention is primarily characterized by the following steps:

Removing two rovings from two separate supplies;

Passing each roving through a separate drawing device;

Ring-spinning from each roving a separate spun yarn;

Collecting each spun yarn as a bobbin on a yarn carrier of separate hollow spindles, wherein the separate hollow spindles are positioned atop one another;

Withdrawing with formation of a yarn balloon from the bobbins the spun yarns and guiding each spun yarn through the hollow spindle axle of the respective hollow spindle;

Routing the spun yarn withdrawn from the upper one of the hollow spindles through the hollow spindle axle of the lower one of the hollow spindles;

Guiding both spun yarns together to a winding device positioned below the lower one of the hollow spindles;

Rotating the hollow spindles as a function of the winding speed of the winding device such that a twist of the spun fibers is at least partially canceled.

Advantageously, the method further comprises the step of severing the spun yarns from the rovings after the step of ring-spinning and before the step of withdrawing.

The present invention further relates to a device for manufacturing a twisted yarn according to the method of the present invention. The inventive device is primarily characterized by:

A first and a second spindle support frame arranged one atop the other;

At least one pair of ring spinning devices, with one of the ring spinning devices connected to the first spindle support frame and the other ring spinning device connected to the second spindle support frame;

Each one of the ring spinning devices comprising a hollow spindle with a permanently installed yarn carrier; and At least one winding device position below the hollow spindles.

Advantageously, the device further comprises drawing devices, wherein each one of the ring spinning devices has one of the drawing devices arranged upstream thereof in a direction of feeding the roving to the ring spinning device. Preferably, each one of the hollow spindles extends through the spindle support frame to which the ring spinning device is connected. Each one of the hollow spindles comprises a whorl positioned below the spindle support frame and driven by a drive belt. Each one of the ring spinning devices expediently comprises a vertically reciprocating ring with ring traveller arranged at the hollow spindle.

Preferably, for two neighboring ones of the pairs of ring spinning devices one of the winding devices is positioned centrally relative to the two pairs.

Preferably, the device further comprises for each one of the pairs of ring spinning devices one drawing device with a roving supply.

The basic principle of the present invention is that conventional ring spinning devices are provided with conventional hollow spindles and that the ring spinning devices are arranged in pairs one atop the other so that the two spun yarns produced in each individual ring spinning device according to the ring spinning process are guided subsequently, while the hollow spindles are rotating under formation of a balloon, through the hollow spindle axle and the resulting twisted yarn is wound below the hollow spindle axle, for example, to form a cross-wound spool of twisted yarn. By correspondingly adapting, respectively, adjusting the spindle rpm during the spinning process, on the one hand, and by taking into consideration the twisted yarn winding velocity during the subsequent twisting process, on the other hand, the different twisting ratios between the individual spun fibers, on the one hand, and the twist of the twisted yarn, on the other hand, can be adjusted, for example, also by driving the two hollow spindles arranged atop one another with different rpm.

The devices for building the spun yarn body such as the spindle drive elements, the ring rail, spinning ring, and ring traveller as well as drawing devices arranged upstream, correspond to the conventional elements of a ring spinning machine whereby the ring rail movement, as is conventional, is centrally controlled in order to produce the desired yarn body.

For the subsequent twisting process the ring rail movements are interrupted. Below each hollow spindle pair, comprised of respectively two hollow spindles arranged one atop the other, winding devices are provided, as is, for example, known from a two-for-one twisting spindle. The winding devices serve for building the twisted yarn cross-wound spool etc. During the twisting process the spun fibers wound onto the spun yarn body are removed from the yarn body in a second process step by building a balloon and guided through the hollow spindle axles of the two hollow spindles to the winding device. The friction roller of the winding device works, as a function of the spindle rpm, with such a velocity (removal velocity), that the twist of the individual spun fibers is either completely or partly canceled.

BRIEF DESCRIPTION OF THE DRAWINGS

The object and advantages of the present invention will appear more clearly from the following specification in conjunction with the accompanying drawings, in which.

DESCRIPTION OF PREFERRED EMBODIMENTS

The present invention will now be described in detail with the aid of several specific embodiments utilizing FIGS. 1 and 2.

Figure 1:
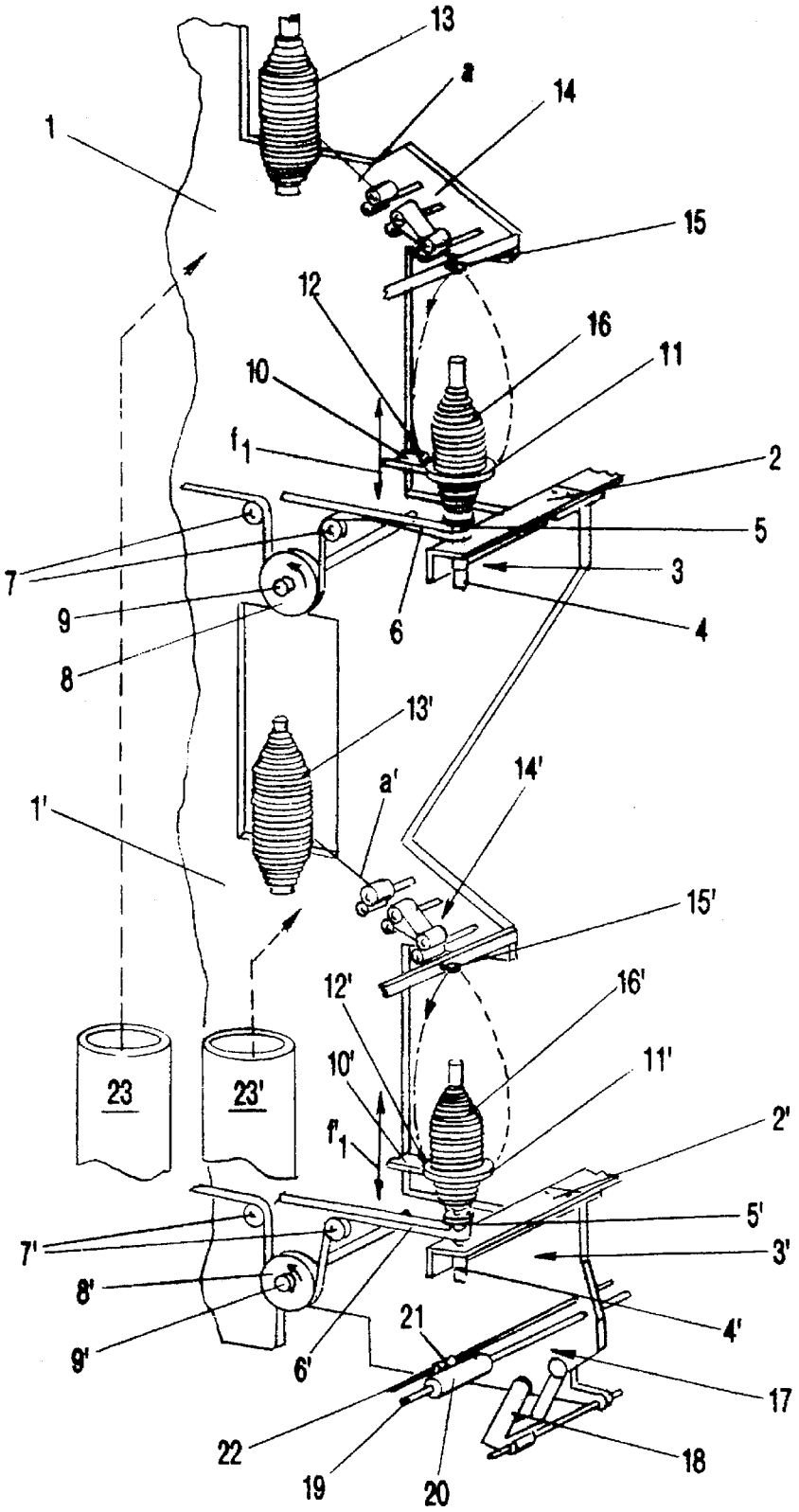
FIG. 1 shows in a schematic representation two ring spinning devices with hollow spindles arranged one atop the other as well as with a winding device arranged downstream during a spinning process representing a first method step.

According to FIG. 1 two only partly represented ring spinning machines 1, 1' are arranged atop one another. Each ring spinning machine comprises a spindle frame 2, 2' for supporting the hollow spindles 3, 3' of which in the drawing for each ring spinning machine only one hollow spindle is represented. The individual hollow spindle 3, 3' comprises a hollow spindle axle 4, 4' with drive whorl 5, 5' about which the spindle drive belt 6, 6' is guided. The drive belt 6, 6' is routed via guide rollers and or tightener rollers 7, 7' and a drive disk 8, 8' which is connected to a centrally driven shaft 9, 9'. Ring holders 10, 10', fastened to a non-represented ring rail and reciprocally moveable in the vertical direction (double arrows f1, f1'), support the spinning rings 11, 11' for the ring travellers 12, 12' conventional in ring spinning devices.

Each hollow spindle 3, 3' has coordinated therewith a roving body, for example, a flyer spool 13, 13' of Fournisseur spool which represents a yarn supply. The roving a or a' supplied by these flyer spools 13, 13' is removed, while the hollow spindle 3, 3' is rotating, and drawn with a conventional drawing device 14, 14'. After passing through a yarn guide 15, 15' positioned on an extension of the axis of the hollow spindle, the roving is twisted on the reciprocating spinning ring 11, 11' and wound to form a spun yarn body 16, 16'.

Below the lower hollow spindle 3' a winding device 17 is arranged which comprises a spool holder frame 18 for securing spool sleeves, a drive shaft 20 driven with a shaft 19, and a reciprocating yarn guide 21, as is, for example, known from winding devices of two-for-one twisting spindles. The reciprocating yarn guide 21 is driven with the reciprocating rod 22 in the direction of double arrows f2 (see FIG. 2).

Figure 2:
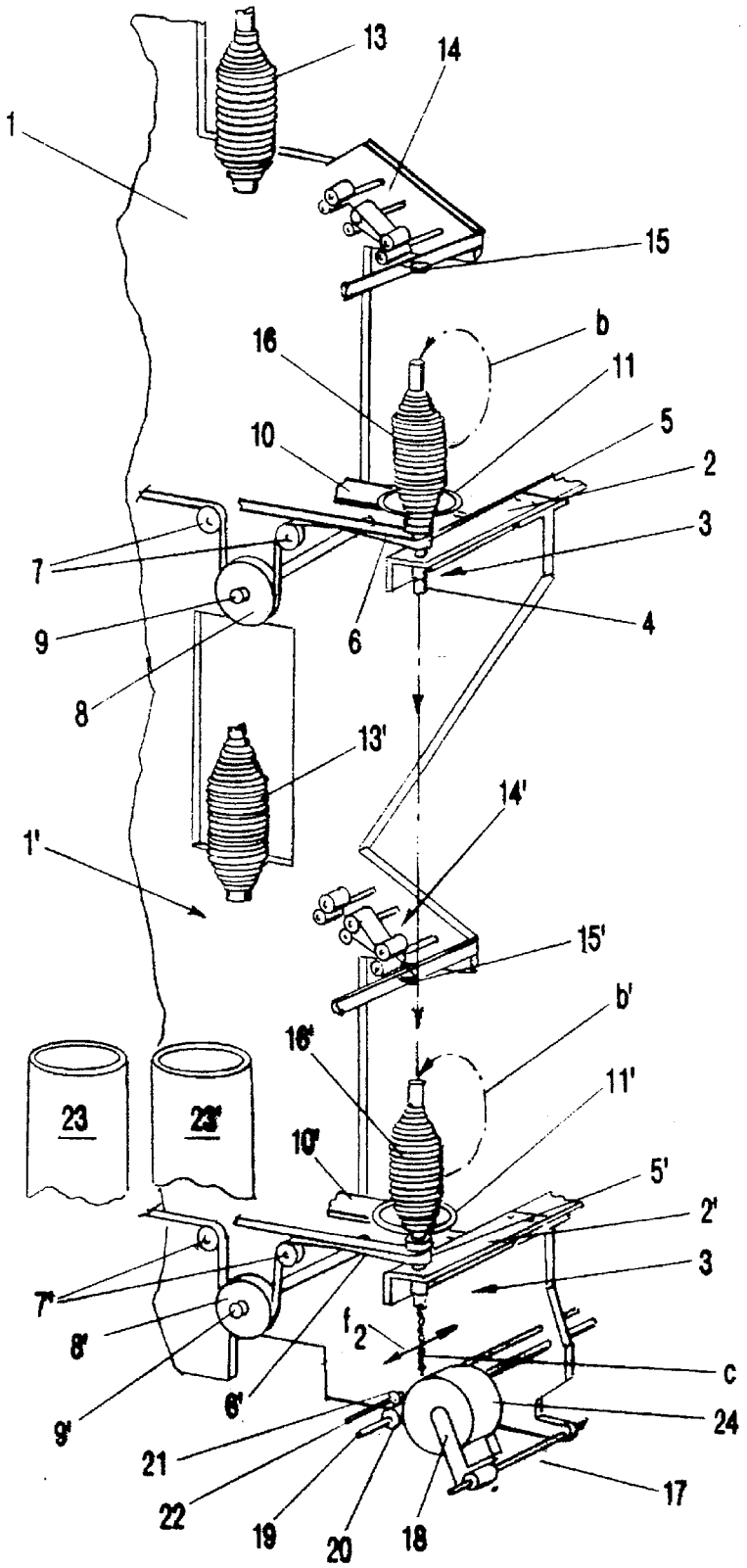
FIG. 2 shows in a schematic representation the same device during a second method step in which the twisting process is performed.

As soon as spun yarn bodies 16, 16' have been wound in a first method step representing the spinning process, the spinning process is interrupted whereby according to FIG. 2 the drive of the ring holder 10, 10' is shut off. The spun yarns b, b' wound as a spun yarn body (bobbin) 16, 16' are removed in a second method step from the yarn body 16, 16' by forming a balloon. The spun yarn b removed from the upper spun yarn body 16 is first guided through the hollow spindle 3 and then together with the spun yarn b' removed from the lower spun yarn body 16' is guided through the lower hollow spindle 3' before both spun yarns b, b' are subsequently wound as a twisted yarn c onto a cross-wound spool 24 driven by the drive roller 20. The hollow spindles 3 and 3' are rotated by the drive belt 6, 6' acting on the respective spindle whorl 5, 5' as a function of the removal velocity of the winding device 17 such that the spun yarns b, b' have the twist resulting from the spinning process completely or at least partially canceled.

As explained supra, the inventive solution is that during the spinning process performed on the ring spinning devices a yarn carrier for building spun yarn bodies 16, 16' is permanently installed on the hollow spindle whereby during the subsequent twisting process the spun yarns are removed and guided through the hollow spindle axle of the rotating hollow spindle to a winding device. In this manner the otherwise needed transport of a spun yarn body from a ring spinning machine to a separate twisting device is obsolete. Furthermore, it is no longer necessary after removing a spun yarn body from a conventional spindle of a ring spinning device to replace it with a new empty spool sleeve.

It is possible to coordinate two pairs of hollow spindles, each comprised of two hollow spindles arranged one atop another, with one common winding device which is then substantially centrally arranged below the two hollow spindle pairs whereby the finished twisted yarn is alternatingly supplied from one of the pairs of spindles. This provides substantially for a continuous process also for winding the twisted yarn. This continuous process can be realized with simple means known from prior art technology with respect to threading, yarn guiding, and twisted yarn connection, for example, by tying a knot or by splicing. Correspondingly, one yarn supply is provided for the two adjacently arranged pairs of hollow spindles.

The present invention is, of course, in no way restricted to the specific disclosure of the specification and drawings, but also encompasses any modifications within the scope of the appended claims.

What I claim is:

1. A method for manufacturing a twisted yarn, said method comprising the steps of:

removing two rovings from two separate supplies;

passing each roving through a separate drawing device;

ring-spinning from each roving a separate spun yarn;

collecting each spun yarn as a bobbin on a yarn carrier of separate hollow spindles, wherein the separate hollow spindles are positioned atop one another;

withdrawing with formation of a yarn balloon from the bobbins the spun yarns and guiding each spun yarn through the hollow spindle axle of the respective hollow spindle;

routing the spun yarn withdrawn from the upper one of the hollow spindles through the hollow spindle axle of the lower one of the hollow spindles;

guiding both spun yarns together to a winding device positioned below the lower one of the hollow spindles;

rotating the hollow spindles as a function of the winding speed of the winding device such that a twist of the spun fibers is at least partially cancelled.

2. A method according to claim 1, further comprising the step of severing the spun yarns from the rovings after the step of ring-spinning and before the step of withdrawing.

3. A device for manufacturing a twisted yarn, said device comprising:

a first and a second spindle support frame arranged one atop the other;

at least one pair of ring spinning devices for producing spun yarns from roving, with one of the ring spinning devices connected to said first spindle support frame and the other ring spinning device connected to said second spindle support frame;

each one of said ring spinning devices comprising a hollow spindle, for twisting the spun yarns, with a permanently installed yarn carrier, for collecting the spun yarns;

each one of said hollow spindles extending through said spindle support frame to which said ring spinning device is connected;

each one of said hollow spindles comprising a whorl positioned below said spindle support frame and driven by a drive belt, said whorls driven at different rpm for achieving predetermined twisting ratios between the individual spun yarns and a predetermined twist of the twisted yarn;

at least one winding device positioned below said hollow spindles for receiving a twisted yarn made by withdrawing with formation of a yarn balloon the spun yarns from said yarn carriers, guiding the spun yarns through said respective hollow spindles, and routing the spun yarn withdrawn from the upper one of said hollow spindles through the lower one of said hollow spindles;

a drawing device for each one of said ring spinning devices arranged upstream of said ring spinning devices in a direction of feeding roving to said ring spinning devices; and each one of said ring spinning devices comprising a vertically reciprocating ring with ring traveller arranged concentrically about said hollow spindle.

4. A device according to claim 3, wherein for two neighboring ones of said pairs of said ring spinning devices one of said winding devices is positioned centrally relative to said two pairs.

5. A device according to claim 3, further comprising for each one of said pairs of ring spinning devices one drawing device with a roving supply.

* * * * *